US006502743B2

(12) United States Patent
Ikeda

(10) Patent No.: US 6,502,743 B2
(45) Date of Patent: Jan. 7, 2003

(54) CARTON HAVING PANEL-INTERLOCKING MEANS

(75) Inventor: Tamio Ikeda, Kanagawa (JP)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/968,116

(22) Filed: Oct. 1, 2001

(65) Prior Publication Data

US 2002/0084316 A1 Jul. 4, 2002

Related U.S. Application Data

(63) Continuation of application No. PCT/US00/08701, filed on Feb. 4, 2000.

(51) Int. Cl.[7] ..... B65D 5/02

(52) U.S. Cl. ..... 229/198.2; 206/427; 229/103.2

(58) Field of Search ..... 229/103.2, 185, 229/198.2; 206/140, 427

(56) References Cited

U.S. PATENT DOCUMENTS

| | | | | | |
|---|---|---|---|---|---|
| 1,333,102 | A | | 3/1920 | Dietsche | 248/351 |
| 3,064,877 | A | | 11/1962 | Forrer | 229/150 |
| 3,104,795 | A | | 9/1963 | Adams | 229/155 |
| 3,186,545 | A | * | 6/1965 | Conrades | 229/103.2 |
| 3,249,284 | A | | 5/1966 | Wood | 229/198.2 |
| 3,305,161 | A | | 2/1967 | Offer | 229/93 |
| 3,341,908 | A | * | 9/1967 | Lock | 229/103.2 |
| 3,604,614 | A | | 9/1971 | Sternfeld | 206/485.1 |
| 3,655,117 | A | * | 4/1972 | Weiss | 229/103.2 |
| 3,701,181 | A | * | 10/1972 | Lock | 229/198.2 |
| D229,485 | S | | 12/1973 | Petersen | D9/416 |
| 4,433,806 | A | | 2/1984 | Ganz | 229/198.2 |
| 4,433,807 | A | * | 2/1984 | Ganz | 229/198.2 |
| 4,611,754 | A | * | 9/1986 | Sutherland | 229/198.2 |
| 4,708,284 | A | * | 11/1987 | Sutherland et al. | 229/198.2 |
| 5,360,104 | A | | 11/1994 | Sutherland | 206/147 |
| 5,855,318 | A | | 1/1999 | Baxter | 229/198.2 |
| 5,924,628 | A | * | 7/1999 | Oliff | 229/198.2 |
| 5,941,453 | A | * | 8/1999 | Oliff | 229/103.2 |

FOREIGN PATENT DOCUMENTS

| | | |
|---|---|---|
| FR | 1424536 | 3/1966 |

* cited by examiner

*Primary Examiner*—Gary E. Elkins
(74) *Attorney, Agent, or Firm*—Tsugihiko Suzuki

(57) ABSTRACT

A carton comprises first and second panels disposed in an overlapping relationship, and an interlocking arrangement for interconnecting the first and second panels. The interlocking arrangement comprises a slit formed in the first panel, and a tab projecting from the free end edge of the second panel and received in the slit. The slit includes a main slit portion disposed generally along the free end edge of the first panel, an intermediate slit potion emanating from an end of the main slit portion and extending away from the free end edge of the first panel, and a terminal slit portion emanating from the intermediate slit portion and extending away from the main slit portion to be disposed generally along the free end edge of the first panel. The tab comprises an ear protruding from at least one of the opposite side edges of the tab. The carton is characterised in that a fold line is disposed between the intermediate and terminal slit portions such that an engaging flap is defined by the fold line and the intermediate and terminal slit portions and connected to the first panel along the fold line. The carton is also characterised in that the ear of the tab is disposed in engagement with the engaging flap.

11 Claims, 9 Drawing Sheets

CARTON HAVING PANEL-INTERLOCKING MEANS

This is a continuation of international application No. PCT/US00/08701, filed Feb. 4, 2000, which is hereby incorporated by reference.

BACKGROUND OF THE INVENTION

This invention relates to a carton for packaging articles such as beverage cans, bottles, bricks and the like and more particularly to a slide type lock or panel-interlocking means for interconnecting two panels for forming a carton wall.

Slide type locks or slide-type panel-interlocking means have been well known in the field of package-manufacturing industry. A slide type lock comprises a tab and a slit. The tab is formed, for example, on an edge of a carton panel while the slit is defined in another panel. The tab is inserted into the slit and locked in the slit to interconnect the two carton panels. For slide locks to become reliable, it is essential that the tab and the slit be arranged to prevent undesired disengagement from each other. One of the conventional approaches for preventing the disengagement is to provide a crank-shaped section at each end of the slit and an outwardly projecting ear at each side edge of the tab. When inserted into such a slit, the tab is engaged at its ears with the carton material adjacent to the crank-shaped sections, which effectively prevents disengagement of the tab from the slit. Examples of the cartons taking such an approach are disclosed in U.S. Pat. Nos. 1,333,102; 3,064,877; 3,186,545; 3,305,161; 3,341,908; and 3,655,117, U.S. Design Patent No. 229,485, and French Patent No. 1,424,536, which are hereby incorporated by reference.

A drawback of the cartons using the above approach is that the material around the crank-shaped sections lacks structural flexibility, which not only interferes with smooth insertion of the tab but also causes the slit to remain slightly opened when the material is deformed due to the insertion of the tab. If remaining deformed after the insertion of the tab, the material around the crank-shaped sections is unlikely to function to prevent disengagement of the tab.

What is needed, therefore, is a carton having a slide-type lock wherein the tab insertion is facilitated and the tab-and-slit engagement is highly reliable to maintain the integrity of the carton.

SUMMARY OF THE INVENTION

According to the invention in one form, a carton having an improved slide-type lock is provided. The carton comprises first and second panels in an overlapping relationship, and an interlocking means for interconnecting the first and second panels. The interlocking means comprises a slit formed in the first panel, and a tab projecting from the free end edge of the second panel and received in the slit. The slit includes a main slit portion disposed generally along the free end edge of the first panel, an intermediate slit potion emanating from an end of the main slit portion and extending away from the free end edge of the first panel, and a terminal slit portion emanating from the intermediate slit portion and extending away from the main slit portion to be disposed generally along the free end edge of the first panel. The tab comprises an ear protruding from at least one of the opposite side edges of the tab. The carton is characterised in that a fold line is provided between the intermediate and terminal slit portions such that an engaging flap is defined by the fold line and the intermediate and terminal slit portions and connected to the first panel along the fold line. The carton is also characterised in that the ear of the tab is disposed in engagement with the engaging flap.

The above arrangement is of utility because when the tab is being inserted into the slit, the engaging flap is easily thrust aside by the tab due to the fold line. This facilitates insertion of the tab into the slit. The arrangement is further of utility because when the tab is fully inserted, the flap having been cleared by the tab is allowed to easily recover from the folded position because of the flexibility provided by the fold line. Without the fold line, the folded material tends to remain folded and hardly returns by itself to the initial unfolded position. The flap having returned to the unfolded position is ready to engage the ear of the tab to serve as a stopper for preventing the tab from coming out of the slit.

In a preferred form of the invention, the slit may further include an expansion slit portion emanating from the terminal slit portion and extending away from the free end edge of the first panel. The expansion slit portion serves to expand the end area of the slit when the first panel is manipulated to open the slit to facilitate insertion of the tab.

In another preferred form of the invention, the ear of the tab may be disposed adjacent to the free end edge of the second panel with a space therebetween so that the ear is provided with an edge defined for engagement with the engaging flap. This further insures that the engaging flap serve as the stopper.

In another preferred form of the invention, the first panel may include a panel body and a foldable panel portion connected to the panel body along a fold line, and the main slit portion may be formed in the foldable panel portion. In this form of the invention, it is further preferred that the intermediate slit portion is formed also in the foldable panel portion while the terminal slit portion is disposed in general alignment with the fold line between the panel body and the foldable panel portion. Such an arrangement allows the slit to wide open when the foldable panel is folded with respect to the panel body.

DETAILED DESCRIPTION OF THE PREFERRED EMBODIMENTS

Figure 4:
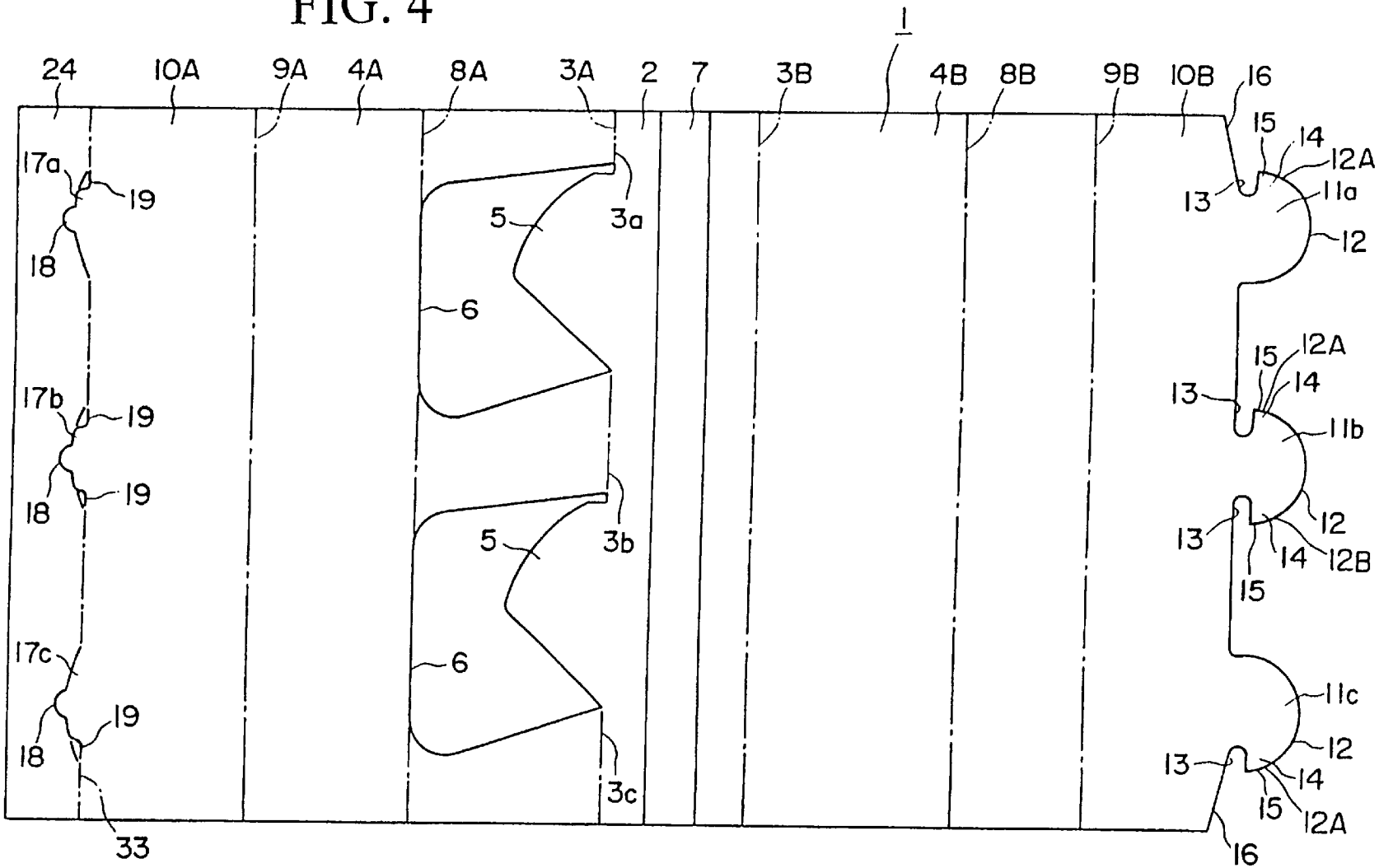
FIG. 4 is a plan view of the entire carton blank in FIG. 3.
Figure 5:
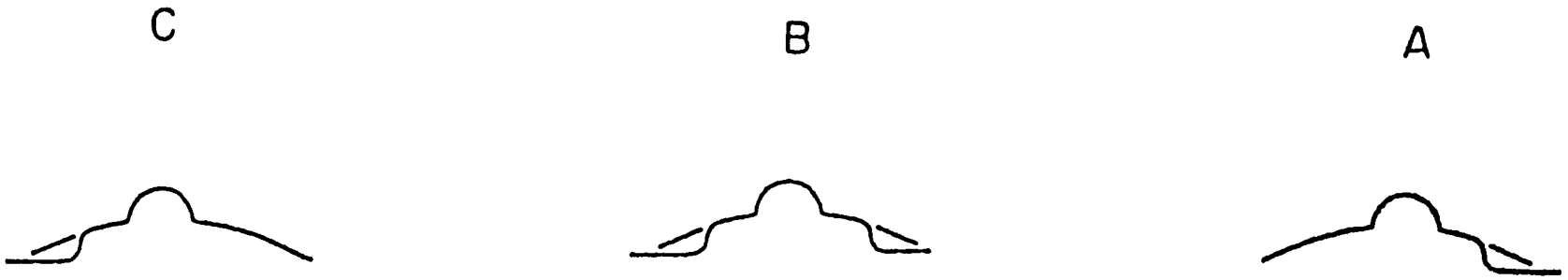
FIG. 5 is an enlarged plan view of the slits in FIG. 4 wherein all the other parts of the carton blank have been omitted and not shown.

FIG. 4 shows a carton blank for forming a carton of the first embodiment according to the present invention. The blank 1 is rectangular in shape and formed of paperboard. The blank is of a size such that it can package two articles of the same shape. At the middle of the rectangular blank 1, there is provided an elongate rectangular top wall 2. A pair of side walls 4A and 4B are connected to the opposite side edges of the top wall 2 along fold lines 3A and 3B respectively. The fold line 3A is interrupted by tabs 5 and comprises three separate portions 3*a*, 3*b* and 3*c* wherein the portions 3*a* and 3*c* are located adjacent to the opposite longitudinal edges of the blank 1 while the portion 3*b* is located intermediate the portions 3*a* and 3*c*. Each of the fold line 3B and the fold line portions 3*a*, 3*b* and 3*c* may be a continuous score line. Otherwise, it may be formed of a row of short cut lines or a combination of short score lines and short cut lines.

The tabs 5 and 5 are formed from the side wall 4A and joined to the top wall 2. The tabs 5 have a shape corresponding to the shape of a part of the top of each article to be packaged in the carton. A pair of openings 6 and 6 are formed in the side wall 4A adjacent respectively to the tabs 5 to expose a part of each article. Each opening 6 is essentially diamond-shaped and extends from the fold line 3A to a fold line 8A at an intermediate position along the vertical length of the side wall 4A. The top wall 2 is formed with a tear strip 7 for facilitating removal of the articles from the carton. The fold line 8A is aligned with the lower edges of the openings 6 and 6 so that the upper half of the side wall 4A may be disposed at an angle with respect to the lower half thereof when the blank is erected into a carton. The side wall 4B is formed with a fold line 8B similar and parallel to the fold line 8A. The location of the fold line 8B is such that the elevation of the fold line 8B is slightly lower than that of the fold line 8A upon formation of the carton.

Bottom lap panels 10A and 10B are connected respectively to the side walls 4A and 4B along fold lines 9A and 9B. The bottom lap panels 10A and 10B in combination form a composite bottom wall 10 when the carton is erected. Each of the fold lines 9A and 9B may be a continuous score line. Otherwise, the fold lines 9A and 9B each may be formed of a row of spaced short cut lines, or a combination of short score lines and short cut lines. The bottom lap panel 10A is a form of the first panel as in the appended claims while the bottom lap panel 10B is a form of the second panel.

Three tabs 11*a*, 11*b* and 11*c* protrude from the free end edge of the bottom lap panel 10B. These tabs are arranged along the free edge at equal spacings. The end tabs 11*a* and 11*c* each has a configuration which is a mirror image of the other tab. Each end tab 11*a* and 11*c* has an arched outline 12 including an outer side edge 12A along which there is formed an essentially U-shaped notch 13 that defines a hook 14 having a tip end 15. The hook 14 is a form of the ear as in the appended claims. In addition, sloping edge portions 16 are formed along the free end edge of the lap panel 10B at the locations adjacent to the opposite longitudinal edges of the blank 1. Due to the sloping edge portions 16, the width of the lap panel 10B gradually decreases toward the longitudinal edges of the blank 1.

The intermediate tab 11*b* also has an arched outline 12. Essentially U-shaped notches 13 and 13 are formed along the opposite side edges 12A and 12B of the tab 11*b*, respectively. These notches 13 and 13 define a pair of hooks 14 having respective tip ends 15. Each of these hooks 14 is a form of the ear as in the appended claims. The hooks 14 of the tabs 11*a*, 11*b* and 11*c* are of the same configuration except for their orientations.

The bottom lap panel 10A has three slits 17*a*, 17*b* and 17*c* for receiving the tabs 11*a*, 11*b* and 11*c*, respectively. These slits 17*a*, 17*b* and 17*c* are disposed along the free end edge of the lap panel 10A at the location corresponding to the tabs 11*a*, 11*b* and 11*c*. The distance between the opposite ends of each slit 17*a*, 17*b* and 17*c* is generally equal to, or slightly greater than, the maximum transverse size of the each tab 11*a*, 11*b* and 11*c* along the fold line 9B.

Figure 3:
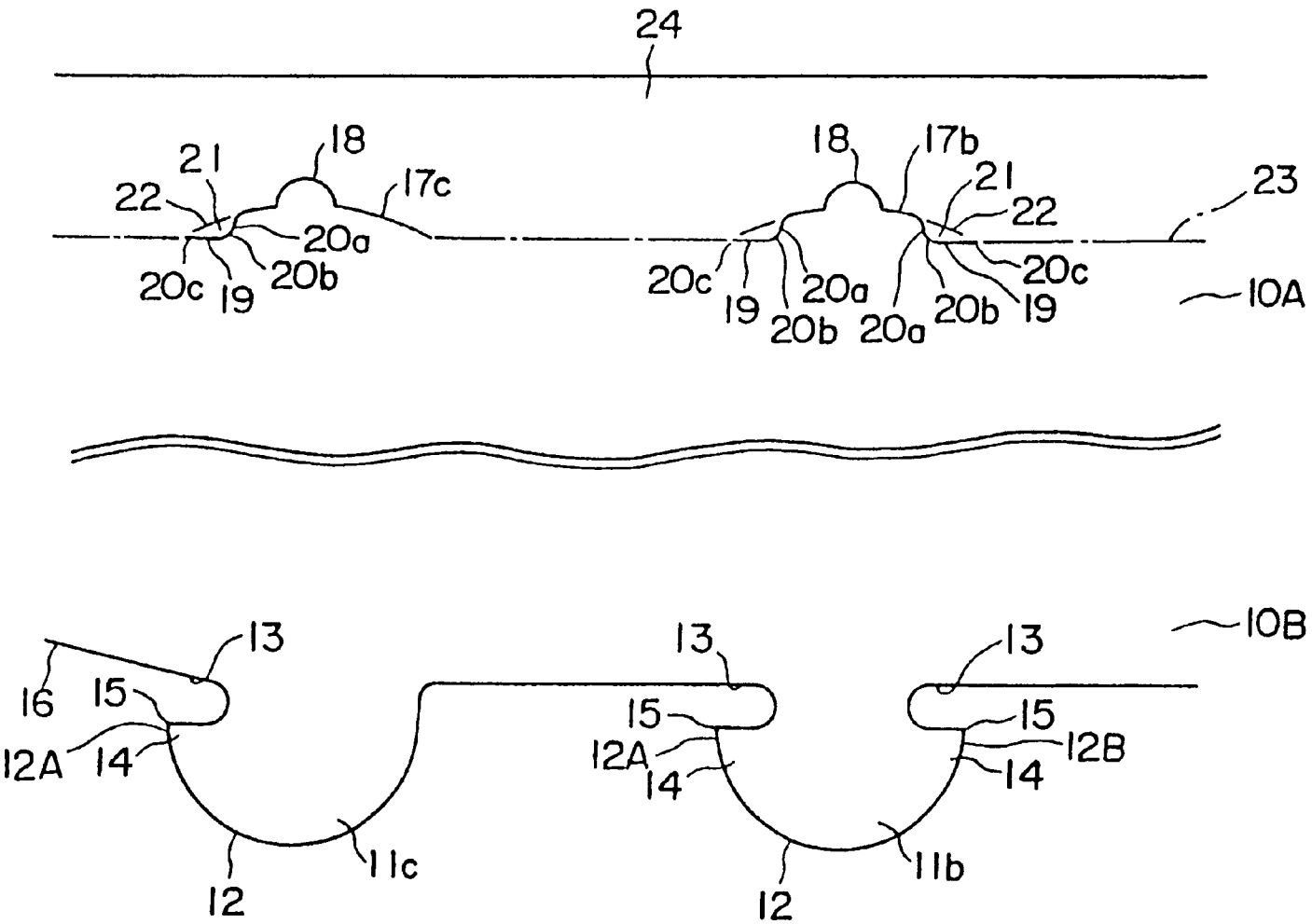
FIG. 3 is an enlarged fragmental plan view of the carton blank from which the carton of FIG. 1 is erected.

The end slits 17*a* and 17*c* each has a configuration that is a mirror image of the other slit. Each end slit 17*a* and 17*c* includes a main slit portion that is disposed generally along, and arcuately curved convexly toward, the free end edge of the lap panel 10A. The main slit portion of each end slit includes at its longitudinally intermediate position a rounded protrusion 18 serving as a guide means for facilitating insertion of the associated tab 11*a* or 11*c*. Each end slit 17*a* and 17*c* further includes at the outer end thereof an intermediate slit portion 20*a* and a terminal slit portion 20*c*. As shown in FIG. 3, the intermediate slit portion 20*a* emanates from the respective main slit portion and extends away from the free end edge of the bottom lap panel 10A. The terminal slit portion 20*c* emanates from the intermediate slit portion 20*a* and extends away from the main slit portion along the free end edge of the bottom lap panel 10A. However, a rounded comer slit portion 20*b* may be provided to interconnect the intermediate and terminal slit portions 20*a* and 20*c*. The intermediate and terminal slit portions 20*a* and 20*c* and optionally the comer slit portion 20*b*, in combination, form a crank-shaped section 19.

The bottom lap panel 10A further includes a triangular engaging flap 21 near the crank-shaped section 19 of each end slit 17*a* and 17*c*. The two sides of each engaging flap 21 are defined by the intermediate and terminal slit portions 20*a* and 20*c* of the adjacent slit. Each engaging flap 21 is joined to the lap panel 10A along a fold line 22 so that it is easily foldable with respect to the lap panel 10A. More specifically, each flap 21 is defined or surrounded by the respective fold line 22 and the adjacent intermediate and terminal slit portions 20*a* and 20*c*. The fold line 22 may comprise a continuous score line or one or more cut lines.

The intermediate slit 17*b* also includes a main slit portion that is arcuately curved convexly toward the free end edge of the bottom lap panel 10A. The main slit portion of the intermediate slit 17*b* is provided at its mid position with a rounded protrusion 18 and at its each end with a crank-shaped section 19. Each crank-shaped section 19 of the intermediate slit 17*b* is virtually identical to that of each end slit 17*a* and 17*c*, and thus the description thereof is omitted. A triangular engaging flap 21 is also provided near each crank-shaped section 19 of the intermediate slit 17*b*. Each engaging flap 21 of the intermediate slit 17*b* is virtually identical to those provided near the respective crank-shaped sections of the end slits 17*a* and 17*c*, and thus the description thereof is omitted.

The bottom lap panel 10A includes a foldable panel portion 24 connected along an interrupted fold line 23. The fold line 23 extends across the lap panel 10A while interrupted by the slits 17*a*, 17*b* and 17*c*. As a result, the main slit portion of each slit 17*a*, 17*b* and 17*c* is located in the foldable panel portion 24. The intermediate slit portion 20*a* of each slit is also located in the foldable panel portion 24 whereas the terminal slit portion 20*c* is arranged in general alignment with the fold line 23.

The tabs 11*a*, 11*b* and 11*c* mate respective with the slits 17*a*, 17*b* and 17*c* to constitute a panel-interlocking means.

The operation of the interlocking means is now described hereinafter.

Figure 1:
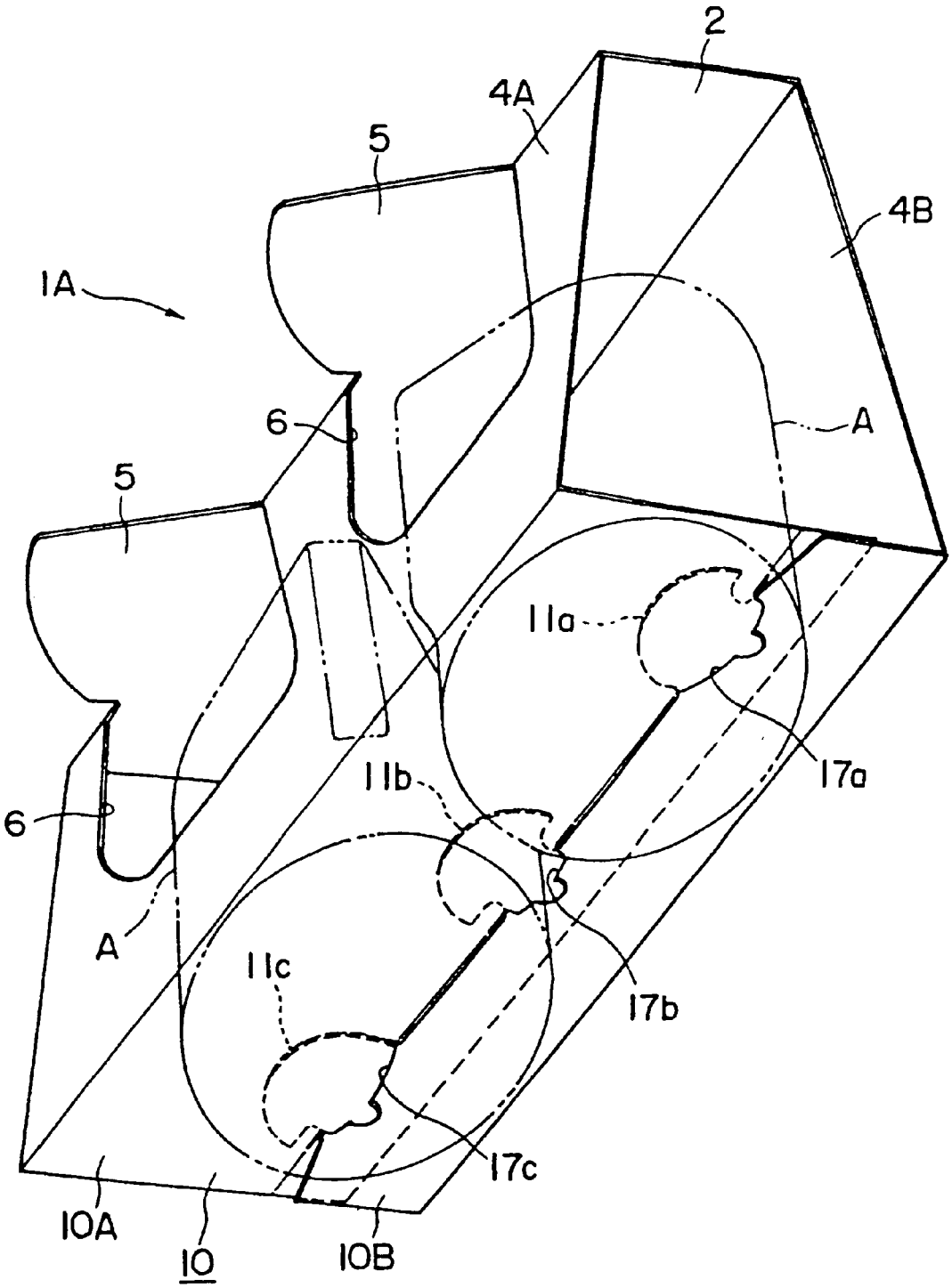
FIG. 1 is a bottom, right and front perspective view of a carton of the first embodiment according to the invention.
Figure 2:
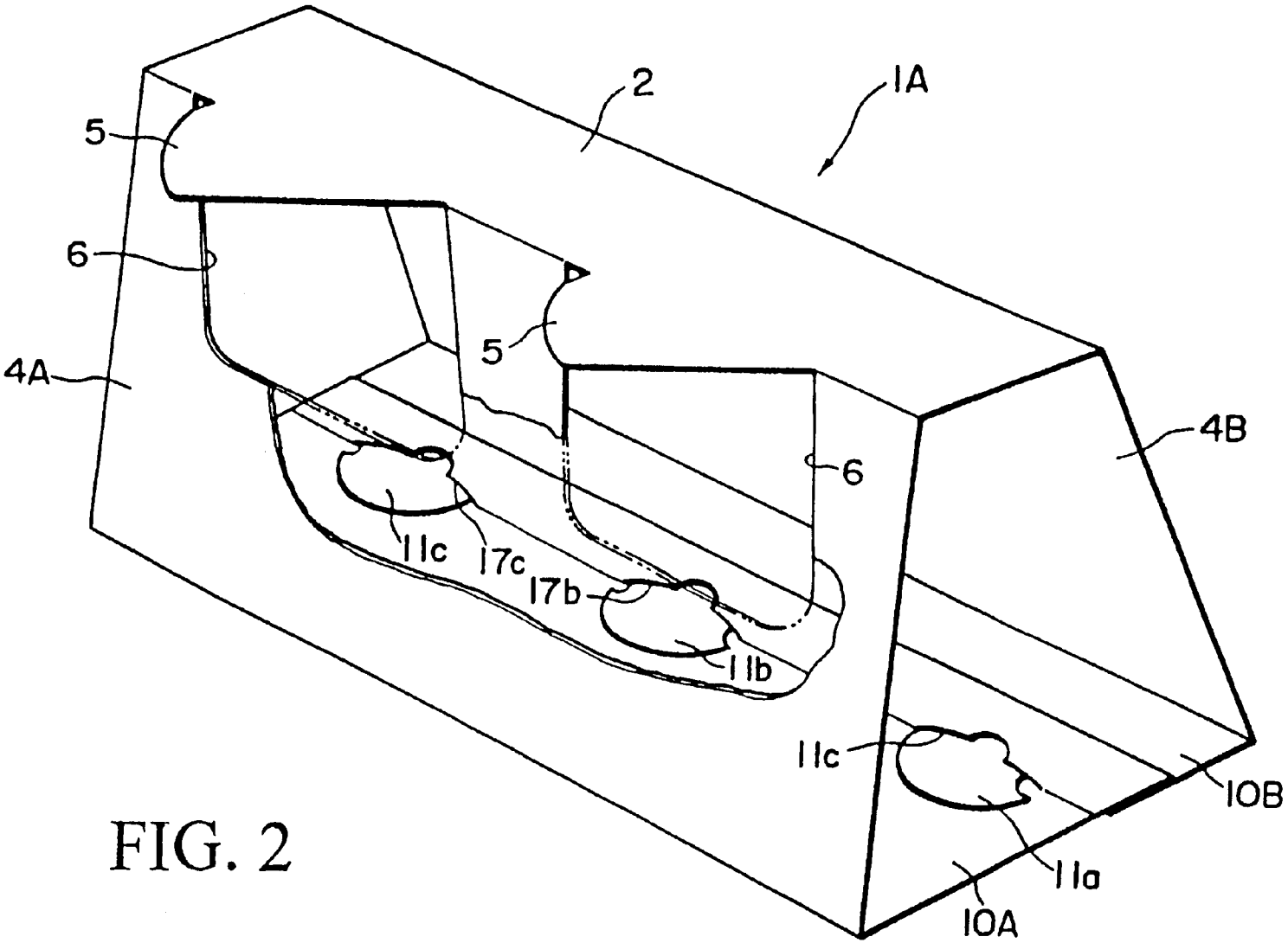
FIG. 2 is a top, right and front perspective view, partially cut away, of the carton of FIG. 1, showing the carton without the packaged articles.

To set up a carton 1A as in FIGS. 1 and 2 from the blank shown in FIG. 4, two articles "A" in an inverted orientation are placed on the top wall 2 of the blank 1. The blank 1 is then folded along the fold lines 3A, 3B, 8A, 8B, 9A and 9B to bring the bottom lap panels 10A and 10B to positions close to each other. The foldable portion 24 of the lap panel 10A is folded inwardly or downwardly of the panel 10A along the fold line 23 to open the slits 17*a,* 17*b* and 17*c*. The tabs 11*a,* 11*b* and 11*c* of the bottom lap panel 10B are then inserted into the opened slits 17*a,* 17*b* and 17*c,* respectively. While the tabs 11*a,* 11*b* and 11*c* are inserted, the triangular engaging flaps 21 are thrust aside by the tabs 11*a,* 11*b* and 11*c* whereupon they are folded inwardly or downwardly about their respective fold lines 22. Because of this yielding disposition of the flaps 21, the insertion of the tabs 11*a,* 11*b* and 11*c* is achieved easily without substantial resistance of the material of the bottom lap panel 10A. When fully inserted, the tabs 11*a,* 11*b* and 11*c* clear the respective flaps 21 and release them from the thrusting force. The released flaps 21 then recover from their respective folded positions and return to their original unfolded positions due to the flexibility provided by the fold lines 22. The flaps 21 having returned to the unfolded position are ready to engage the hooks 14 of the tabs 11*a,* 11*b* and 11*c* to serve as a stopper as will be described later. The tabs 11*a,* 11*b* and 11*c* having been inserted into their respective slits 17*a,* 17*b* and 17*c* connect the lap panels 10A and 10B together and retain the carton 1A in the erected form as shown in FIGS. 1 and 2.

If the erected carton undergoes external force, one or more of the tabs 11*a,* 11*b* and 11*c* may be pulled outwardly of the respective slits. However, the engaging flaps 21 as in the unfolded positions would engage the hooks 14 of the tabs 11*a,* 11*b* and 11*c* to prevent withdrawal of the tabs from the slits. This assures that the carton 1A is held in the erected condition while the articles "A" are packaged therein.

Having been described, the arrangement of the present invention facilitates insertion of the tabs 11*a,* 11*b* and 11*c* into the slits 17*a,* 17*b* and 17*c* and still effectively prevents disengagement of the tabs from the respective slits.

Figure 6:
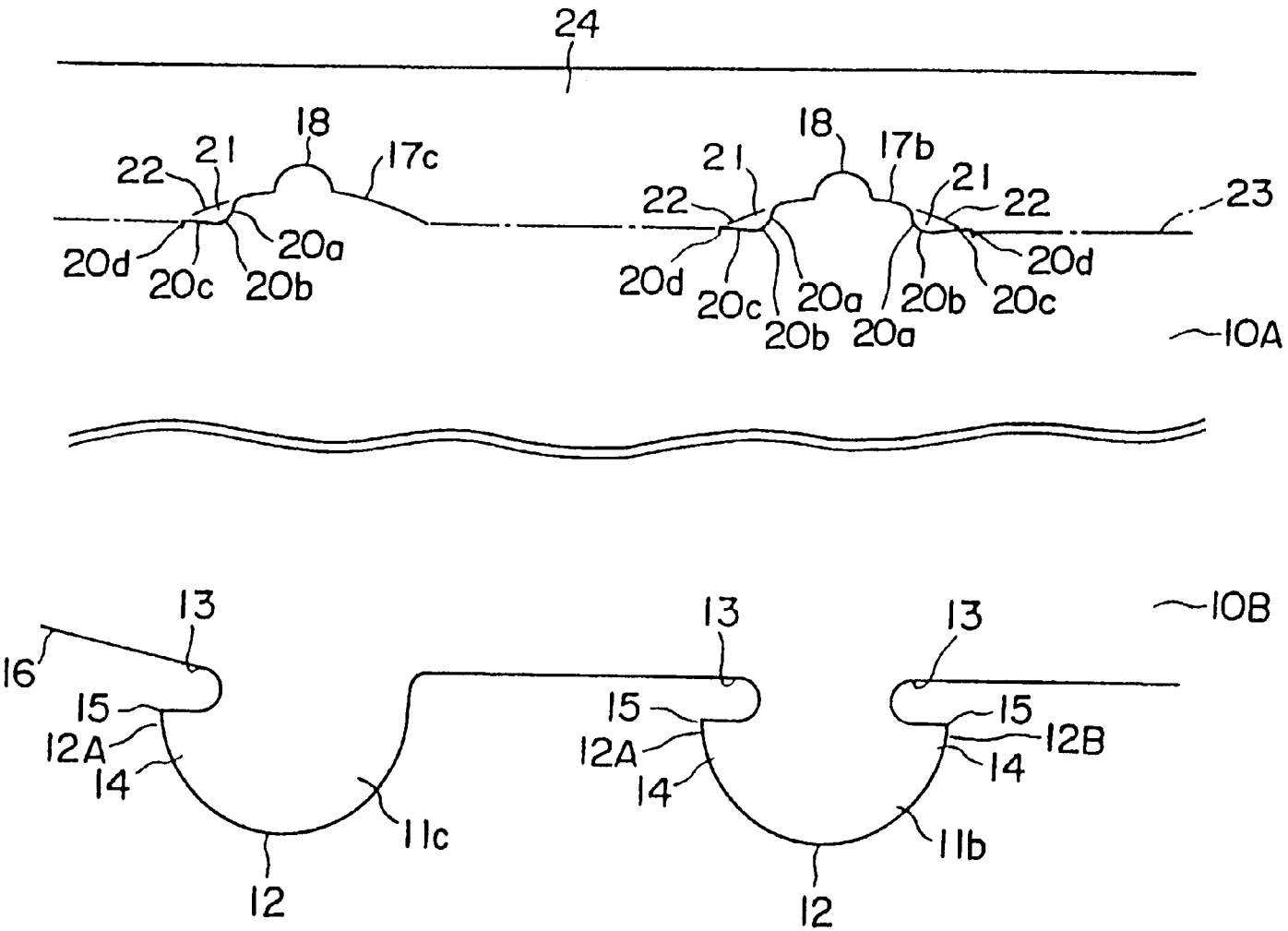
FIG. 6 is an enlarged fragmental plan view of a carton blank from which a carton of the second embodiment of the invention may be erected.
Figure 7:
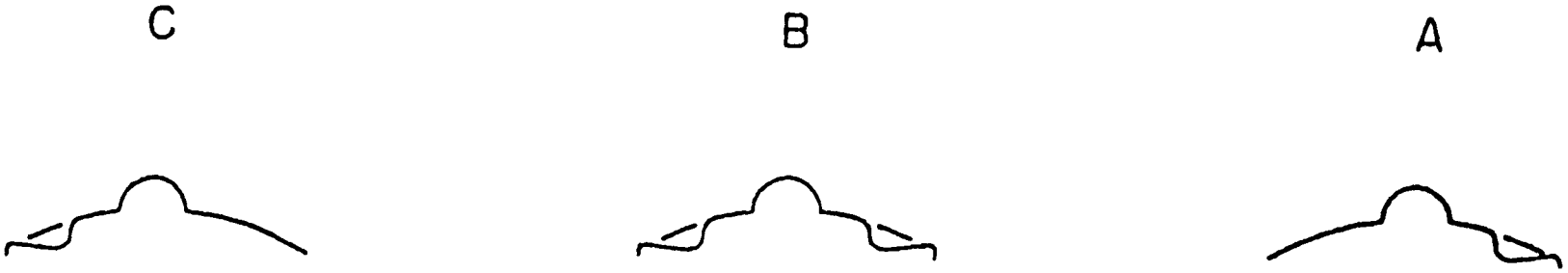
FIG. 7 is an enlarged plan view of the slits in FIG. 6 wherein all the other parts of the carton blank have been omitted and not shown.

FIG. 6 illustrates a blank for forming a carton of the second embodiment according to the invention. The interlocking means in FIG. 6 differs from that in FIG. 3 in that the terminal slit portion 20*c* of each slit in FIG. 6 extends somewhat into the foldable panel portion 24 such that the terminal slit portion 20*c* is slightly inclined to the fold line 23. It further differs from the interlocking means in FIG. 3 in that an expansion slit portion 20*d* is provided at the outer end of each terminal slit portion 20*c* and extends away from the free end edge of the bottom lap panel 10A. The remainder of the interlocking means in FIG. 6 is virtually identical to that in FIG. 3, and thus the description thereof is omitted. However, the slits 17*a,* 17*b* and 17*c* in FIG. 6 are also shown in FIG. 7 without the other parts of the blank to clarify their shapes and structures. Due to the terminal and expansion slit portions 20*c* and 20*d,* the slits 17*a,* 17*b* and 17*c* in FIG. 6 provide larger openings therealong when the foldable panel portion 24 is folded about the fold line 23. This facilitates insertion of the associated tabs 11*a,* 11*b* and 11*c* into the slits 17*a,* 17*b* and 17*c*.

Figure 8:
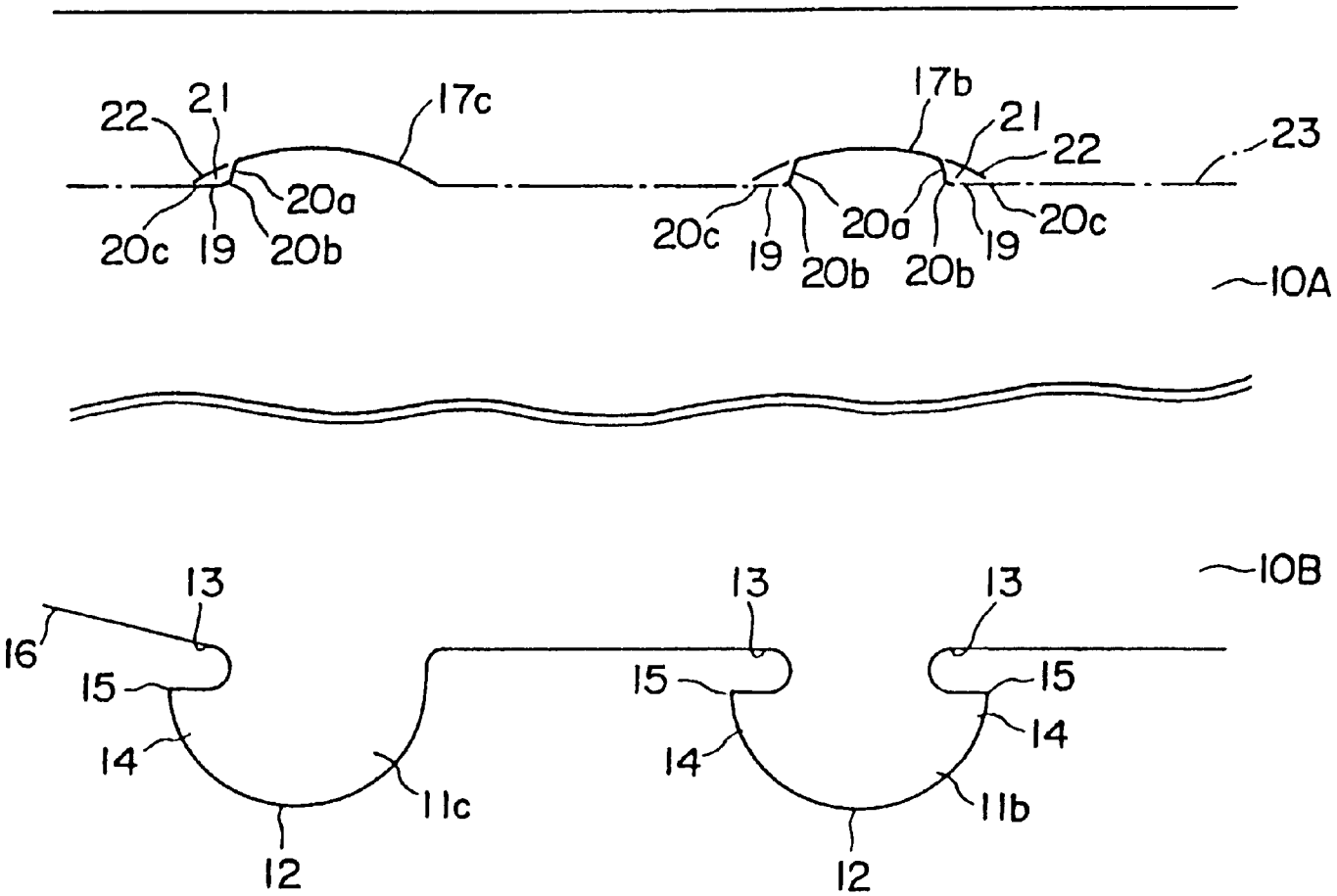
FIG. 8 is an enlarged fragmental plan view of a carton blank from which a carton of the third embodiment of the invention may be erected.

FIG. 8 illustrates a blank for forming a carton of the third embodiment according to the invention, which is a modified form of the blank in FIG. 3. The interlocking means in FIG. 8 differs from that in FIG. 3 in that each slit 17*a* (not shown), 17*b* and 17*c* has no rounded protrusion at its longitudinally mid position. The remainder of the interlocking means in FIG. 8 is virtually identical to that in FIG. 3. FIG. 8 suggests that the arcuate slits 17*a,* 17*b* and 17*c* by themselves can serve as guide means for facilitating insertion of the associated tabs 11*a,* 11*b* and 11*c* without the assistance of the rounded protrusions.

Figure 9:
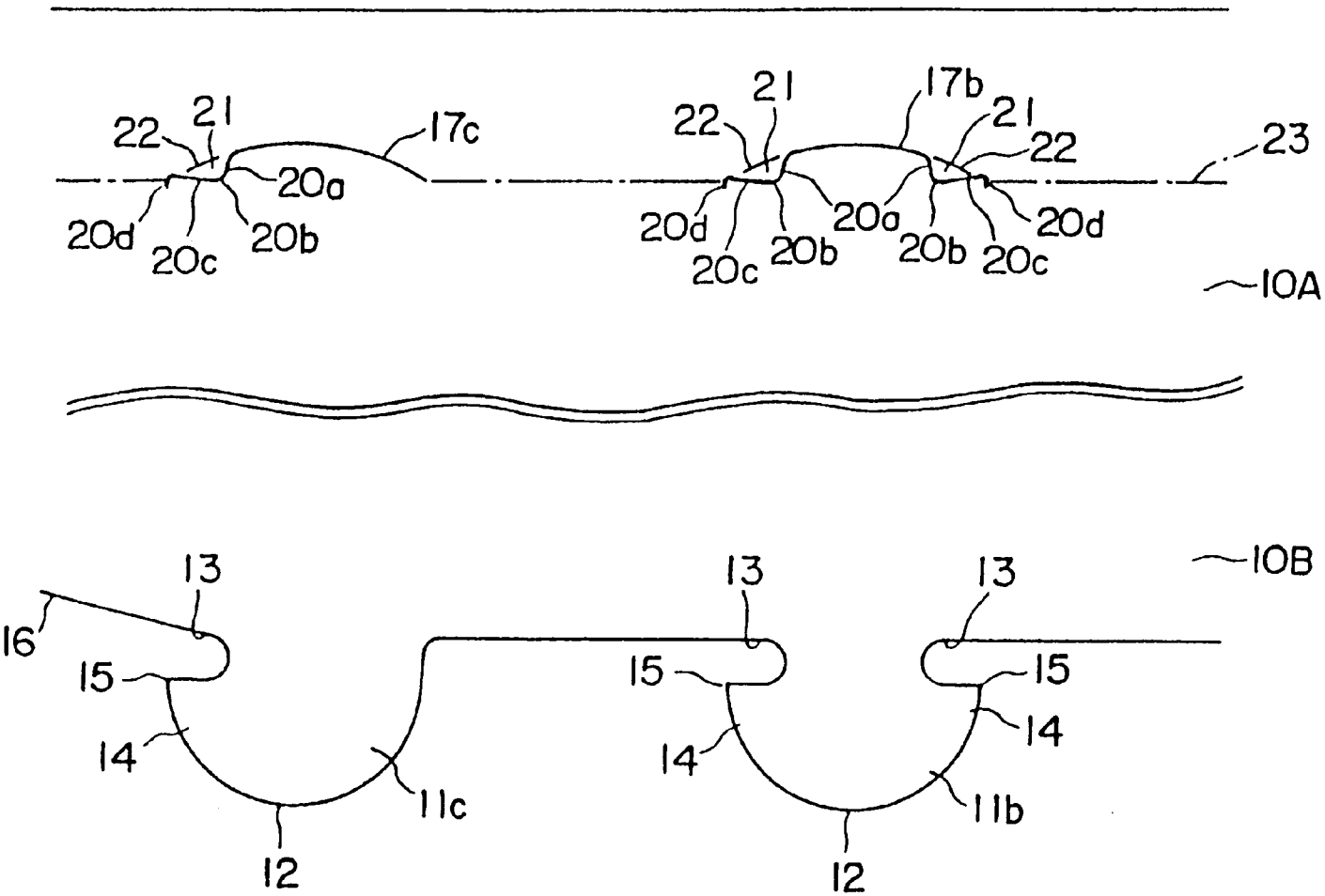
FIG. 9 is an enlarged fragmental plan view of a carton blank from which a carton of the fourth embodiment of the invention may be erected.

FIG. 9 illustrates a blank for forming a carton of the fourth embodiment according to the invention, which is a modified form of the blank in FIG. 6. The interlocking means in FIG. 9 differs from that in FIG. 6 in that each slit 17*a* (not shown), 17*b* and 17*c* has no rounded protrusion at its longitudinally mid position. The remainder of the interlocking means in FIG. 9 is virtually identical to that in FIG. 6. FIG. 9 also suggests that the arcuate slits 17*a,* 17*b* and 17*c* by themselves can serve as guide means for facilitating insertion of the associated tabs 11*a,* 11*b* and 11*c* without the assistance of the rounded protrusions.

It will be readily appreciated that although the three pairs of tab and slit are employed in each of the preceding embodiments, more or less than three pairs of tab and slit may be used to interconnect two panels or panel portions of a carton. For example, the tab 11*b* and slit 17*b* may be omitted from the carton of each embodiment to connect the respective panel portions by the other two pairs tab and slit only.

It will be also appreciated that the panels or panel portions to be interconnected by the interlocking means are not limited to the bottom lap panels but include a pair of top lap panels for forming a carton top wall, a pair of side lap panels for forming a carton side wall, a pair of end closure flaps for forming a carton end wall and the like.

What is claimed is:

1. A carton comprising first and second panels disposed in an overlapping relationship, and an interlocking means for interconnecting said first and second panels, wherein said interlocking means comprises a slit formed in said first panel, and a tab projecting from a free end edge of said second panel and received in said slit, wherein said slit includes a main slit portion disposed generally along a free end edge of said first panel, an intermediate slit potion emanating from an end of said main slit portion and extending away from said free end edge of said first panel, and a terminal slit portion emanating from said intermediate slit portion and extending away from said main slit portion to be disposed generally along said free end edge of said first panel, wherein said tab comprises an ear protruding from at least one of opposite side edges of said tab, and wherein a fold line is disposed between said intermediate and terminal slit portions such that an engaging flap is defined by said fold line and said intermediate and terminal slit portions and connected to said first panel along said fold line, and that said ear of said tab is disposed in engagement with said engaging flap.

2. The carton according to claim 1 wherein said slit further includes an expansion slit portion emanating from said terminal slit portion and extending away from said free end edge of said first panel.

3. The carton according to claim 1 wherein said ear of said tab is disposed adjacent to said free end edge of said second panel with a space therebetween so that said ear is provided with an edge defined for engagement with said engaging flap.

4. The carton according to claim 1 herein said first panel comprises a panel body and a foldable panel portion connected to said panel body along a fold line, and wherein said main slit portion of said slit is formed in said foldable panel portion.

5. The carton according to claim 4 wherein said intermediate slit portion is formed in said foldable panel portion, and said terminal slit portion is disposed in general alignment with said fold line between said panel body and said foldable panel portion.

6. A carton comprising first and second panels disposed in an overlapping relationship, and a lock for interconnecting said first and second panels, wherein said lock comprises a slit formed in said first panel, and a tab projecting from a free end edge of said second panel and received in said slit, said tab comprising an ear projecting from at least one of opposite side edges of said tab, wherein at least part of said slit is shaped to define an engaging flap, said engaging flap being connected to said first panel by a first fold line such that said engaging flap is defined by said first fold line and said slit, wherein said ear of said tab is disposed in engagement with said engaging flap, wherein said first panel comprises a panel body and a foldable panel portion connected to said panel body along a second fold line, and wherein at least a portion of said slit is formed in said foldable panel portion.

7. The carton according to claim 6 wherein said slit includes a main slit portion, an expansion slit portion emanating from an end of said main slit portion and extending away from a free end edge of said first panel.

8. The carton according to claim 6 wherein said ear of said tab is disposed adjacent to said free end edge of said second panel with a space therebetween so that said ear is provided with an edge defined for engagement with said engaging flap.

9. A carton blank comprising first and second panels and a lock for interconnecting said first and second panels in a set up condition, wherein said lock comprises a slit formed in said first panel and a tab projecting from a free end edge of said second panel and adapted to be received in said slit, said tab comprising an ear protruding from at least one of opposite side edges of said tab, wherein at least part of said slit is shaped to define an engaging flap, said engaging flap being connected to said first panel by a first fold line such that an engaging flap is defined by said first fold line and said slit, wherein said ear of said tab is capable of being disposed in engagement with said engaging flap in a set up carton, wherein said first panel comprises a panel body and a foldable panel portion connected to said panel body along a second fold line, and wherein at least a portion of said slit is formed in said foldable panel portion.

10. The blank according to claim 9 wherein said slit includes a main slit portion and an expansion slit portion emanating from an end of said main slit portion and extending away from a free end edge of said first panel.

11. The blank according to claim 9 wherein said ear of said tab is disposed adjacent to said free end edge of said second panel with a space therebetween so that said ear is provided with an edge defined for engagement with said engaging flap.

* * * * *